US008857815B2

(12) United States Patent
Hongo et al.

(10) Patent No.: US 8,857,815 B2
(45) Date of Patent: Oct. 14, 2014

(54) PAPER FEEDING DEVICE, IMAGE SCANNING DEVICE, PAPER FEEDING METHOD AND COMPUTER READABLE MEDIUM

(75) Inventors: Masanobu Hongo, Ishikawa (JP); Tetsuo Funada, Ishikawa (JP); Nobuhisa Yamazaki, Ishikawa (JP)

(73) Assignee: PFU Limited, Kahoku-shi (JP)

( * ) Notice: Subject to any disclaimer, the term of this patent is extended or adjusted under 35 U.S.C. 154(b) by 257 days.

(21) Appl. No.: 13/308,072

(22) Filed: Nov. 30, 2011

(65) Prior Publication Data

US 2012/0235929 A1 Sep. 20, 2012

(30) Foreign Application Priority Data

Mar. 18, 2011 (JP) ..... 2011-060235

(51) Int. Cl.
*B65H 7/06* (2006.01)
*B65H 7/02* (2006.01)

(52) U.S. Cl.
CPC ..... *B65H 7/06* (2013.01); *B65H 2553/30* (2013.01); *B65H 2511/528* (2013.01); *B65H 2515/82* (2013.01); *B65H 2801/06* (2013.01)
USPC ..... 271/258.01; 271/265.01; 271/258.02; 399/21

(58) Field of Classification Search
CPC ..... B65H 7/06; B65H 7/02; B65H 2553/30
USPC ..... 271/258.01, 265.01, 258.02; 399/18, 399/21, 8
See application file for complete search history.

(56) References Cited

U.S. PATENT DOCUMENTS

| | | | | |
|---|---|---|---|---|
| 2007/0070456 | A1 | 3/2007 | Nishimura | |
| 2007/0114716 | A1 | 5/2007 | Morikawa et al. | |
| 2007/0177887 | A1 * | 8/2007 | Haas et al. | 399/17 |

FOREIGN PATENT DOCUMENTS

| | | | |
|---|---|---|---|
| JP | 57169767 | A * | 10/1982 |
| JP | Hei-05-058507 | | 3/1993 |
| JP | 7-334185 | | 12/1995 |
| JP | 2001302021 | A * | 10/2001 |
| JP | 2005-205679 | | 8/2005 |
| JP | 2007-079263 | | 3/2007 |
| JP | 2007-137655 | | 6/2007 |

OTHER PUBLICATIONS

English Translation of JP 2001-302021, dated Dec. 5, 2013.*
Chinese Office action issued on Feb. 26, 2014 in corresponding Chinese Application No. 201210048525.3, including English translation 14pp.
Japanese Office action issued on Mar. 18, 2014 in corresponding Japanese Application No. 2011-060235, including English translation 7pp.

* cited by examiner

*Primary Examiner* — Luis A Gonzalez
(74) *Attorney, Agent, or Firm* — Christie, Parker & Hale, LLP

(57) ABSTRACT

There is provided a paper feeding device including: a microphone which detects sound occurred on a paper conveying path; a pre-processing unit which performs pre-processing on a signal of the sound detected by the microphone; and a jam detection unit which detects a jam of paper based on the sound signal on which the pre-processing is performed, a reference value about intensity of the sound, and a reference value about a duration time of the sound.

10 Claims, 8 Drawing Sheets

Upper surface of chassis of image scanning device 52

PAPER FEEDING DEVICE, IMAGE SCANNING DEVICE, PAPER FEEDING METHOD AND COMPUTER READABLE MEDIUM

CROSS-REFERENCE TO RELATED APPLICATIONS

This application is based on and claims priority under 35 USC 119 from Japanese Patent Application No. 2011-060235 filed Mar. 18, 2011.

BACKGROUND OF THE INVENTION

Field of the Invention

The present invention relates to a technology for detecting a jam which may occur in an image scanning device or a printing device.

SUMMARY OF THE INVENTION

According to an aspect of the invention, there is provided a paper feeding device including: a microphone which detects sound occurred on a paper conveying path; a pre-processing unit which performs pre-processing on a signal of the sound detected by the microphone; and a jam detection unit which detects a jam of paper based on the sound signal on which the pre-processing is performed, a reference value about intensity of the sound, and a reference value about a duration time of the sound.

BRIEF DESCRIPTION OF DRAWINGS

Exemplary embodiments of the present invention will be described in detail based on the following figures, wherein.

DESCRIPTION OF THE PREFERRED EMBODIMENTS

As an exemplary embodiment of the present invention, the following will describe an image scanning device (so-called scanner) to which a new framework for detecting the occurrence of a jam is applied with reference to the drawings.

Figure 1:
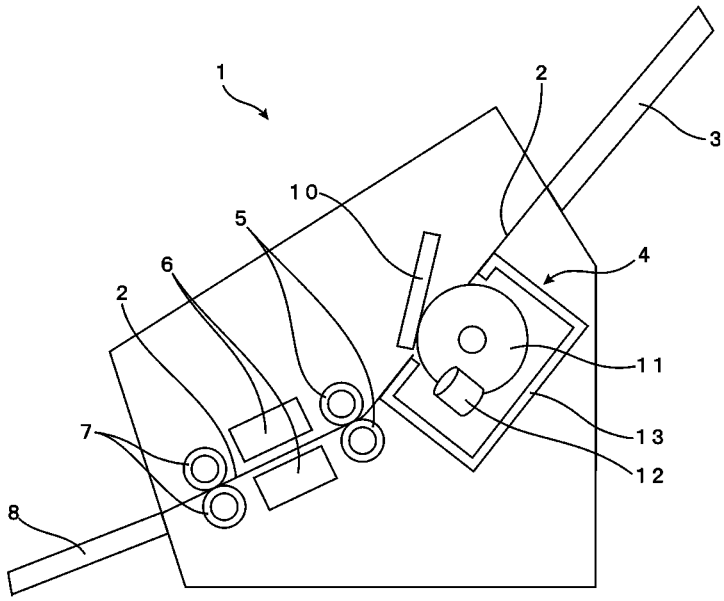
FIG. 1 is a diagram schematically showing a configuration of an image scanning device according to a first embodiment.

FIG. 1 schematically shows the overall configuration of an image scanning device 1 according to a first embodiment.

The image scanning device 1 has, sequentially from the upstream side of a paper conveying path 2 where manuscript sheets of papers pass through, a paper hopper 3, a paper feeding device 4, a paper conveying roller 5, an image scanning unit 6, a paper conveying roller 7, a paper stacker 8, and a control unit (not shown) for controlling the components.

In a configuration of the image scanning device 1, like the conventional image scanning device, manuscript sheets of paper mounted on the paper hopper 3 are fed by the paper feeding device 4 into a chassis one by one, conveyed to the paper conveying roller 5, the image scanning unit 6 for scanning the manuscript paper, and the paper conveying roller 7 in this order along the paper conveying path 2, and discharged to the paper stacker 8 outside the chassis. The image scanning unit 6 scans an image from the manuscript paper being conveyed along the paper conveying path 2 as described above.

The control unit includes components such as a CPU, an ROM, an RAM, and a communication device like the conventional image scanning device.

The image scanning device 1 is different from the conventional one in that the paper feeding device 4 has a function to detect an anomaly such as a jam (paper jam) based on sound that occurs when the manuscript paper moves on the paper conveying path 2.

To realize such a function, besides a paper feeding mechanism (a paper separation pad 10 and a paper separation roller 11) similar to those in the conventional device, the paper feeding device 4 has a microphone 12 for detecting sound that occurs on the paper conveying path 2, a sound insulating chamber 13 disposed in such a manner as to surround the microphone 12, and an operation unit (not shown) for detecting the occurrence of an anomaly such as a jam by performing information processing.

Preferably the microphone 12 is disposed in the vicinity of a location (for example, the paper separation roller 11) subject to jamming in order to collect sound from the location (the paper separation roller 11 in the present embodiment). Further, a known microphone can be employed, in which case, rather than a non-directional microphone, a more directional one should preferably be used and disposed toward the location subject to occurrence of sound in order to collect the sound from the manuscript paper more effectively.

The sound insulating chamber 13 is preferably made of a material excellent in sound insulating properties and configured so that the microphone 12 may be prevented from being exposed in the chassis (in particular, in the vicinity of the conveying path 2), to inhibit the microphone 12 from detecting sound (for example, sound outside the chassis) other than that from the manuscript paper being conveyed on the conveying path 2.

The operation unit in the paper feeding device 4 includes components necessary for information processing such as a CPU, an ROM, and an RAM. The operation unit will be described in detail later with reference to FIG. 2.

Figure 2:
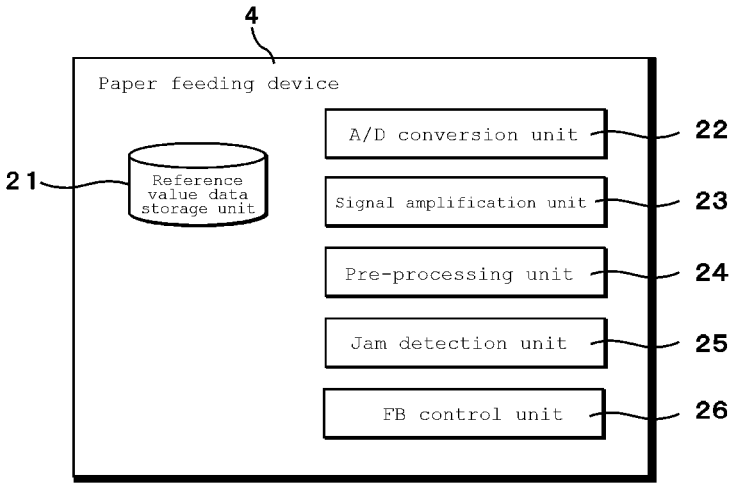
FIG. 2 is a diagram showing a functional configuration of a paper feeding device.

FIG. 2 shows the functional configuration of the operation unit in the paper feeding device 4.

The operation unit in the paper feeding device 4 is provided with a reference value data storage unit 21, an A/D conversion unit 22, a signal amplification unit 23, a pre-processing unit 24, a jam detection unit 25, and an FB control unit 26. The reference value data storage unit 21 is realized functionally by using a storage device such as an ROM or an RAM. On the other hand, the A/D conversion unit 22, the signal amplification unit 23, the pre-processing unit 24, the jam detection unit 25, and the FB control unit 26 are realized functionally, for example, when the CPU reads a predetermined program from the storage device such as the ROM or the RAM into the RAM and executes it. The following will describe the functions of each of those units.

The reference value data storage unit 21 cross-checks the signal of sound that occurs from the manuscript paper being conveyed on the conveying path 2, to store data which provides a reference value necessary to detect the occurrence of an anomaly such as a jam. In the first embodiment, the reference value data storage unit 21 stores at least 2 pairs of combinations of a reference value about an intensity of the sound and that about a duration time of the sound. Hereinafter, a combination of the reference values is referred to as a "threshold set".

Specifically, in the 2 pairs of the threshold sets, the respective reference values are set so that the larger the reference value about the sound intensity grows, the smaller the reference value about the duration time may become. For example, the first threshold set is a combination of the reference values focusing on the sound intensity, and the reference value about the duration time is set to an extremely small value (momentary value). On the other hand, the second threshold set is a combination of the reference values focusing on the sound duration, so that the reference value about the sound intensity is set smaller than that used in the first threshold set, while the reference value about the sound duration time is set larger than that used in the first threshold set.

The A/D conversion unit 22 converts an analog signal (for example, voltage signal) output from the microphone 12 into a digital signal.

The signal amplification unit 23 performs amplification processing on the sound signal obtained through the A/D conversion.

The pre-processing unit 24 performs pre-processing on the signal of sound detected by the microphone 12 (in more detail, the digital signal after being subjected to the A/D conversion and the amplification processing). For example, the pre-processing can include such processing as absolute-value processing, square processing, bit processing, envelope processing, low-pass filter processing, averaging processing, smoothing processing, etc. which are performed on the sound signal, thereby speeding up the subsequent processing. It is to be noted that by performing processing such as the envelope processing, the low-pass filter processing, the averaging processing, and the smoothing processing, an outline of the sound signal can be extracted.

The jam detection unit 25 detects a jam based on the pre-processed sound signal, the reference value about the sound intensity, and the reference value about the sound duration time.

Specifically, the jam detection unit 25 cross-checks the outline-extracted sound signal to the first threshold set, to detect an anomaly such as a jam or an excessive impact based on whether or not sound has occurred that has larger intensity than the reference value about the intensity of sound among the first threshold set. Further, the jam detection unit 25 cross-checks the outline-extracted sound signal to the second threshold set, to detect a jam based on whether or not sound having larger intensity than the reference value about the intensity of sound among the second threshold set has occurred continuously for a longer time than the reference value about the duration time. It is to be noted that although the reference value about the duration time is included in the first threshold set, it is set to an extremely short lapse of time and need not be taken into account practically.

Upon detection of the occurrence of an anomaly such as a jam or an excessive impact, the FB control unit 26 performs feedback processing to, for example, supply the paper feeding device 4 or the image scanning device 1 with an instruction signal to cause it to stop operations.

Figure 3:
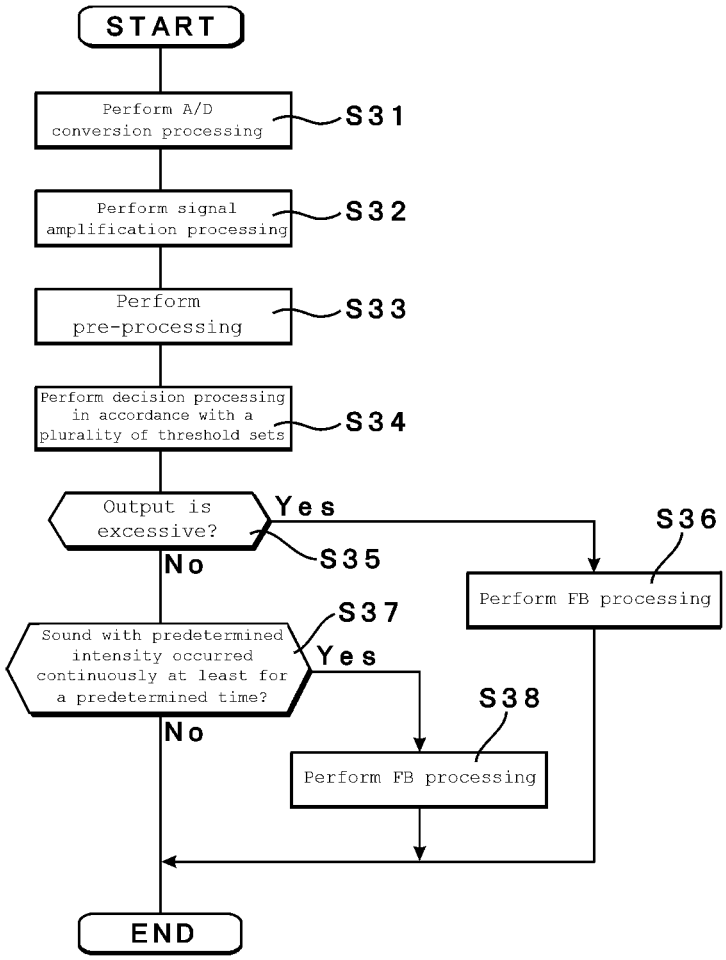
FIG. 3 is a flowchart showing a flow of anomaly detection processing.
Figure 4:
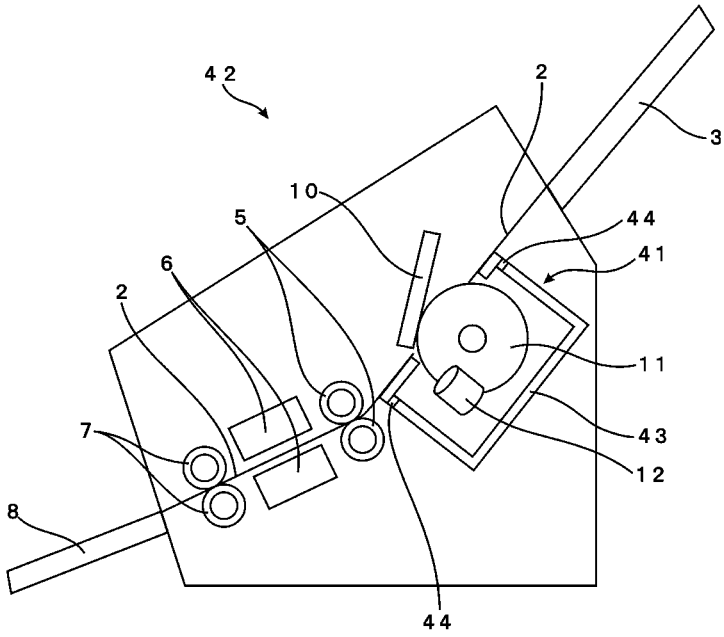
FIG. 4 is a diagram showing avariant of the image scanning device.

FIG. 3 is a flowchart showing the flow of anomaly detection processing by the image scanning device 1 (more specifically, the operation unit in the paper feeding device 4). The following will describe contents of such processing with reference to FIG. 3, etc. It is to be noted that in the present specification, steps (which include partial steps supplied with no reference numerals) shown in the flowchart and the like can be performed concurrently or in order which is arbitrarily changed in such a range that contents of the processing may not become inconsistent.

If the image scanning device 1 operates to start feeding manuscript paper from the paper hopper 3, the A/D conversion unit 22 converts the signal of sound detected by the microphone 12 into a digital signal (S31), which digital signal undergoes amplification processing in the signal amplification unit 23 (S32).

Then, the pre-processing unit 24 performs pre-processing on the sound signal after being subjected to the A/D conversion and the amplification processing, to extract an outline of the sound signal (S33).

Next, the jam detection unit 25 decides whether or not a jam has occurred based on the pre-processed sound signal and a plurality of thresholds (2 threshold sets in the first embodiment) (S34).

Specifically, the jam detection unit 25 cross-checks the sound signal in a predetermined period (for example, the last 1.0 second) among the outline-extracted sound signals to the first threshold set, to decide whether or not sound has occurred that has larger intensity than a reference value about sound intensity in the first threshold set. Further, the jam detection unit 25 cross-checks the sound signal in such a predetermined period to the second threshold set, to decide whether or not the sound having larger intensity than a reference value about sound intensity in the second threshold set has occurred continuously for a longer time than a reference value (for example, 0.5 seconds) about the duration time.

Then, the FB control unit 26 performs feedback processing (S36) if the decision processing (S34) by the jam detection unit 25 proves that the output is excessive, that is, the sound has occurred that has larger intensity than the reference value about the sound intensity in the first threshold set (the decision in S35 proves "YES"). It is to be noted that if the output is excessive, it is considered that a jam has occurred or an excessive impact is applied.

Besides, the FB control unit 26 performs the feedback processing (S38) in a case where the output is not so excessive (the decision in S35 proves "NO") and if sound having a certain degree of intensity has occurred continuously, that is, the sound having the larger intensity than the reference value about the sound intensity in the second threshold set has occurred continuously longer than the reference value about the duration time (the decision in step S37 proves "YES"). In this case, it is considered that a jam has occurred.

As an example of the feedback processing (S36, S38), it may be considered that an instruction signal should be output to stop a motor for driving the paper separation roller 11 (see FIG. 1) so that the manuscript paper may be stopped in conveyance or inversely rotate the paper separation roller 11 so that the manuscript paper can be taken out easily or retract the paper separation roller 11 in such a direction that it may be separated from the paper separation pad 10 (in this case, a retraction mechanism is provided preferably). Besides, it may be considered that an instruction signal should be output to present a message denoting the occurrence of an anomaly such as a jam or an impact to the user (for example, display it on an LCD monitor of the image scanning device 1). This causes the image scanning device 1 (or the paper feeding device 4) to operate in accordance with the instruction signal.

It is to be noted that it is preferable to perform the processing (S34) by the jam detection unit 25 and the decision processing (S35, S37) by the FB control unit 26 described above concurrently at a predetermined time interval. Such a predetermined time interval may be considered to be shorter than the reference value about the sound duration time in the second threshold set, for example. It avoids monitoring from being interrupted and enables continuously monitoring an occurrence situation of an anomaly such as a jam or an impact.

As hereinabove described, by the image scanning device 1 in the present embodiment, a jam and an impact can be detected on the basis of sound, and further, such an anomaly can be prevented from damaging the manuscript paper or the image scanning device 1 by performing the feedback processing to stop or reverse the feeding of the manuscript paper.

Now, a description will be given of merits that the impacts can be detected. For example, by taking into account the reference value about sound duration time also, the image scanning device 1 (more specifically, the paper feeding device 4) can distinguish between snapping sound which occurs when the manuscript paper comes into it and sound which occurs due to jamming. Further, by having the plurality of threshold sets, the image scanning device 1 can stop paper feeding earlier if such large sound is detected as to enable deciding the occurrence of a jam surely, and by taking into the sound duration time also, it can distinguish between sound which occurs when wrinkled manuscript paper is being fed normally and sound which occurs upon occurrence of the jam.

The present invention is not restricted to the first embodiment described hereinabove and can be applied to a variety of variants.

[Variants]

Although in the first embodiment the operation unit in the paper feeding device 4 has performed the jam detection processing by having the components necessary in anomaly detection processing such as the CPU, the ROM, and the RAM, the control unit in the image scanning device 1 may perform the jam detection processing or cooperate with the operation unit to perform the jam detection processing.

FIGS. 4 to 7 respectively show an image scanning device 42 having a paper feeding device 41, an image scanning device 52 having a paper feeding device 51, an image scanning device 62 having a paper feeding device 61, and an image scanning device 72 having a wrinkle smoothing mechanism 71 as the variants of the image scanning device 1 described in the first embodiment. It is to be noted that the components shown in FIG. 4 to 7 denoted by the same reference numerals as those shown in FIG. 1 have almost the same functions and configurations as those described in the first embodiment.

The image scanning device 42 (FIG. 4) is different from the image scanning device 1 in the first embodiment in that it is provided with a member that constitutes a sound insulating chamber 43 and a buffer material 44 between the member and another one in contact with that member. More specifically, the buffer material 44 is disposed between each of the members (which constitute an upper part of the sound insulating chamber 43) in the vicinity of the members constituting the sound insulating chamber 43 of the paper feeding device 41 such as the conveying path 2, the paper separation pad 10, and the paper separation roller 11 and the other member. It enables inhibiting excessive impact sound from occurring when the sound insulating chamber 43 comes in contact with the component such as the paper separation pad 10 or the paper separation roller 11. It also enables inhibiting mistakenly detecting a jam or an impact.

Figure 8:
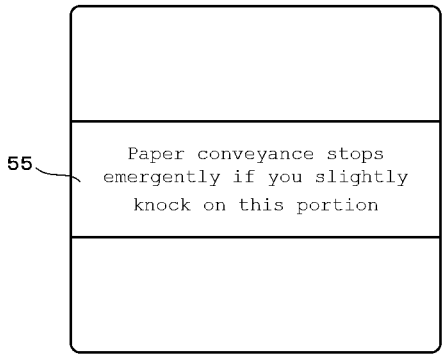
FIG. 8 is a view schematically showing an upper surface of the image scanning device.

The image scanning device 52 (FIG. 6) is different from the image scanning device 1 in the first embodiment in that part of a wall surface of a sound insulating chamber 53 in a paper feeding device 51 is configured to constitute part of a chassis surface of the image scanning device 52 and that this part of the chassis surface constitutes an FB instruction unit 55. Further, it may be considered to give display beforehand on the FB instruction unit 55 to the effect that feedback control is conducted if the device is strongly touched by hitting or busting as exemplified in FIG. 8. With this, if a jam has occurred or is expected to occur, the user can strongly touch the FB instruction unit 55 to permit the paper feeding device 51 to conduct feedback control based on sound caused by user's contact, thereby inhibiting the manuscript paper and the image scanning device 51 from being damaged.

Figure 5:
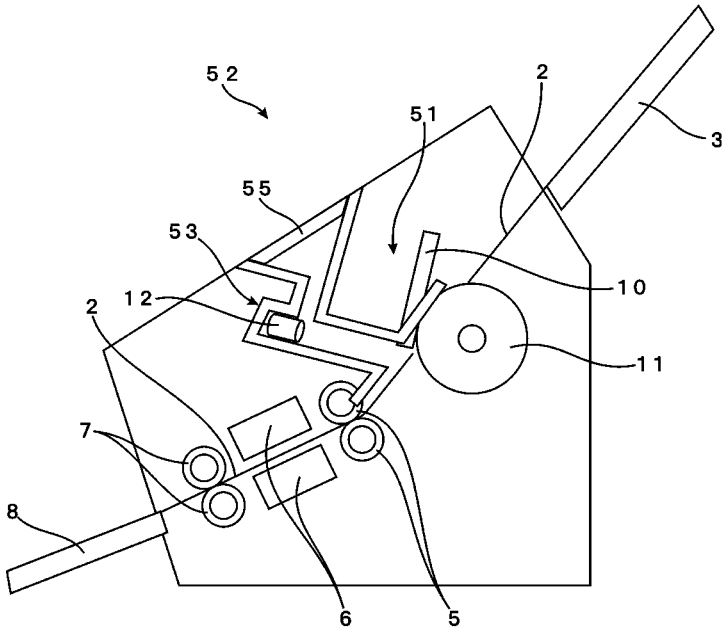
FIG. 5 is a diagram showing another variant of the image scanning device.
Figure 6:
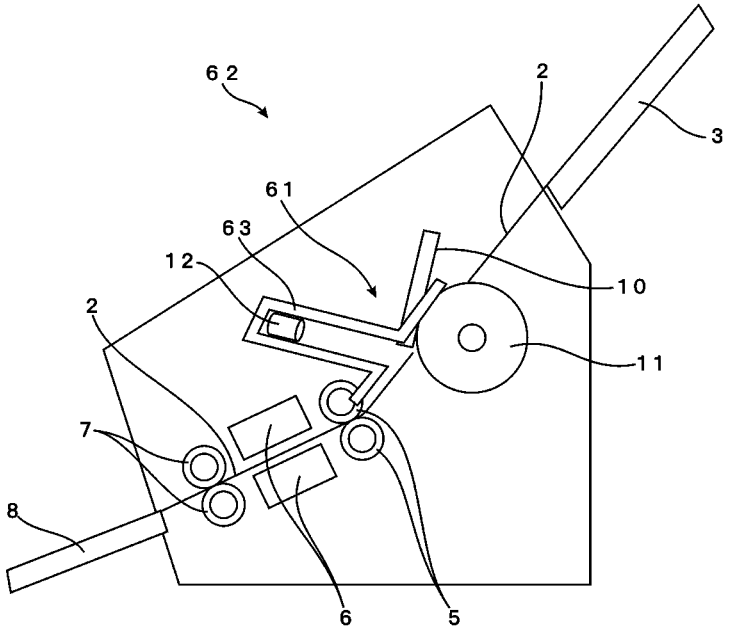
FIG. 6 is a diagram showing a further variant of the image scanning device.
Figure 7:
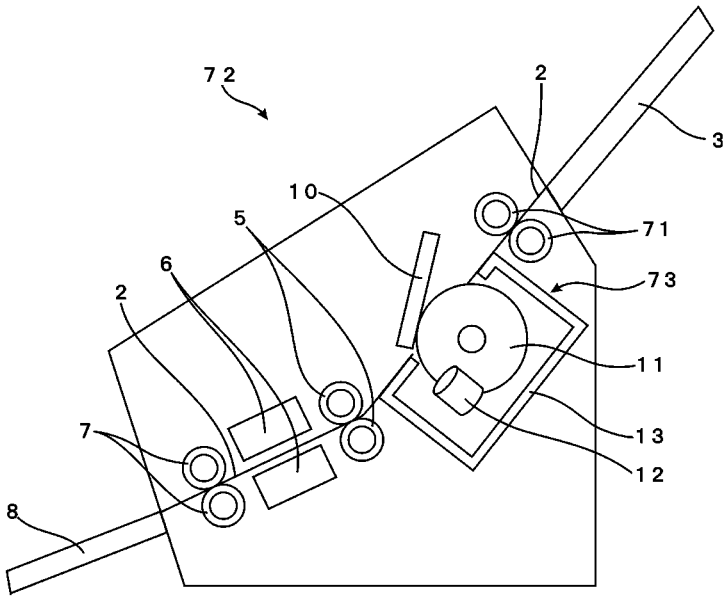
FIG. 7 is a diagram showing a still further variant of the image scanning device.

Further, as shown in FIG. 5, the microphone 12 can be disposed downward to avoid dust such as paper powder of the manuscript paper on the conveying path 2 from staying around the tip of the microphone 12, thereby preventing a deterioration in sound collection performance.

The image scanning device 62 (FIG. 5) is different from the image scanning device 1 in the first embodiment in that a sound insulating chamber 63 of a paper feeding device 61 is disposed upper than the conveying path 2 and that an opening in the sound insulating chamber 63 is disposed toward (downward) a paper separation unit (the downstream side of the paper separation pad 10 and the paper separation roller 11). It enables avoid dust such as paper powder of the manuscript paper on the conveying path 2 from staying around the tip of the microphone 12, thereby preventing a deterioration in sound collection performance, as in the case in FIG. 5.

The image scanning device 72 (FIG. 7) is different from the image scanning device 1 in the first embodiment in that the paper feeding device 73 has the wrinkle smoothing mechanism 71 on the upstream side of the paper separation roller 11 (on the upstream side of the conveying pat 2). The wrinkle smoothing mechanism 71 is constituted of, for example, a pair of rollers, which revolve in such a manner as to catch therebetween the manuscript paper fed from the paper hopper 3 so that wrinkles in the paper may be smoothed out. It enables inhibiting the paper feeding device 73 from mistakenly detecting the occurrence of a jam based on the sound caused by the wrinkles in the manuscript paper.

Further, in any one of the preceding or following variants, a mechanism for determining a degree of the wrinkles in the manuscript paper (a height, a length, the number, or an extent of the wrinkles) may be provided on the upstream side of the paper separation roller 11 (on the upstream side of the conveying path 2) and switched (ON/OFF) as to whether to change contents of the threshold sets in accordance with information denoting the obtained degree and whether to perform the anomaly detection processing (the processing described with reference to FIG. 3). For example, if the degree of wrinkles is in excess of a preset threshold, there is a possibility of mistakenly detecting the occurrence of a jam based on sound caused by the wrinkles, so that it may be considered to turn OFF the performance of the anomaly detection processing.

Further, in the image scanning device 1 according to the first embodiment, another microphone may be provided outside the sound insulating chamber 13 (either outside or inside the image scanning device 1), to detect sound different from that caused by the occurrence of a jam or an impact as noise and cancel the noise from the sound detected by the microphone 12 in the sound insulating chamber 13. It enables more accurately detecting the occurrence of an anomaly such as a jam or an impact.

Further, in the image scanning device 1 according to the first embodiment, a dedicated microphone may be mounted on the chassis of the image scanning device 1 or a hole leading to the sound insulating chamber 13 (more specifically, the microphone 12) may be formed in the chassis of the image scanning device 1 so that the feedback processing (processing of S36 and S38 in FIG. 3) may be performed on the basis of voice of the user. It enables performing the feedback processing based on the voice produced by the user when he/she has sensed any anomaly.

Further, although in the first embodiment, the 2 reference values about sound intensity used in the 2 pairs of threshold sets are different from each other, the 2 reference values about the sound intensity used in the 2 pairs of threshold sets may be made the same value, to change a gain of the post-preprocessing sound signal to be cross-checked. As can be seen from the above, changing the gain of the sound signal instead of providing a plurality of reference values about sound intensity is essentially equivalent to providing a plurality of the reference values and so is covered by the technological scope of the present invention.

Further, the paper feeding devices 4, 41, 51, 61, and 73 in the present invention can be applied not only to the image scanning devices 1, 42, 52, 62, and 72, respectively but also to an apparatus in which paper sheets are conveyed one by one in its chassis such as a printer or a facsimile machine.

It is to be noted that some of the aforesaid variants may be combined in a consistent range.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A paper feeding device comprising:

a microphone that detects sound occurred on a paper conveying path;

a pre-processing unit that performs pre-processing on a signal of the sound detected by the microphone;

a storage that stores a first set for detecting a momentary sound and a second set for detecting a continuous sound which respectively include a reference value for an intensity of the sound and a reference value for a duration time of the sound; and a jam detection unit that detects a jam of paper based on the sound signal on which the pre-processing is performed, the first set and the second set.

2. The paper feeding device according to claim 1, wherein the respective reference values are set so that the larger the reference value for the sound intensity is, the smaller the reference value for the duration time may be.

3. The paper feeding device according to claim 1, wherein the pre-processing is outline extraction processing for extracting an outline of the sound signal.

4. The paper feeding device according to claim 1, further comprising a paper separation unit that separates the paper conveyed on the paper conveying path from other sheets of paper, wherein the microphone is disposed in the vicinity of the paper separation unit.

5. An image scanning device comprising:

a paper conveying path;

an image scanning unit that scans an image from paper conveyed on the paper conveying path;

a microphone that detects sound occurred on the paper conveying path;

a pre-processing unit that performs pre-processing on a signal of the sound detected by the microphone;

a storage that stores a first set for detecting a momentary sound and a second set for detecting a continuous sound which respectively include a reference value for an intensity of the sound and a reference value for a duration time of the sound; and a jam detection unit that detects a jam of the paper based on the sound signal on which the pre-processing is performed, the first set and the second set.

6. The image scanning device according to claim 5, wherein the microphone is disposed in a cavity with a partial wall surface formed as a part of a surface of a chassis of the image scanning device.

7. The image scanning device according to claim 6, wherein operations of conveyance along the paper conveying path are stopped if the device is touched on the part of the surface of the chassis corresponding to the part of the wall surface of the cavity.

8. The image scanning device according to claim 6, further comprising a buffer material between a first member that constitutes the cavity and a second member that comes in contact with the first member.

9. An image scanning device comprising:

a paper conveying path;

an image scanning unit that scans an image from paper conveyed on the paper conveying path;

a microphone that detects sound occurred on the paper conveying path;

a pre-processing unit that performs pre-processing on a signal of the sound detected by the microphone;

a jam detection unit that detects a jam of the paper based on the sound signal on which the pre-processing is performed, a reference value about intensity of the sound, and a reference value about a duration time of the sound, wherein the microphone is disposed in a cavity with a partial wall surface formed as a part of a surface of a chassis of the image scanning device; and a buffer material between a first member that constitutes the cavity and a second member that comes in contact with the first member.

10. A non-transitory computer-readable medium storing thereon a computer program used in a computer, the computer program causing the computer to perform the steps of:

performing pre-processing on a signal of sound detected by a microphone;

storing a first set for detecting a momentary sound and a second set for detecting a continuous sound which respectively include a reference value for an intensity of the sound and a reference value for a duration time of the sound; and detecting a jam of paper based on the sound signal on which the pre-processing is performed, the first set and the second set.

* * * * *